US005103267A

United States Patent [19]

Wada et al.

[11] Patent Number: 5,103,267

[45] Date of Patent: Apr. 7, 1992

[54] IMAGE FORMING SYSTEM FOR PERFORMING SIMPLEX AND DUPLEX RECORDING

[75] Inventors: Kenichi Wada; Tsukasa Yagi; Tomohiko Masuda; Hirohisa Kitano; Itaru Saitoh; Ken Matsubara; Kohichi Shingaki, all of Osaka, Japan

[73] Assignee: Minolta Camera Kabushiki Kaisha, Osaka, Japan

[21] Appl. No.: 503,533

[22] Filed: Apr. 3, 1990

[30] Foreign Application Priority Data

Apr. 4, 1989 [JP] Japan ..... 1-86171
Apr. 7, 1989 [JP] Japan ..... 1-89169
Apr. 7, 1989 [JP] Japan ..... 1-89170

[51] Int. Cl.[5] ..... G03G 21/00

[52] U.S. Cl. ..... 355/321; 355/308; 355/319; 355/323

[58] Field of Search ..... 271/3.1, 9; 355/308, 355/309, 313, 318, 319, 321, 323, 244, 203, 204

[56] References Cited

U.S. PATENT DOCUMENTS 4,537,497 8/1985 Masuda ..... 355/313
4,538,906 9/1985 Brown ..... 271/3.1 X
4,553,831 11/1985 Dixon ..... 271/3.1 X
4,568,169 2/1986 Wada et al. ..... 355/319
4,745,439 5/1988 Hanada et al. ..... 355/244
4,750,016 6/1988 Kusumoto et al. ..... 355/313
4,772,917 9/1988 Tani ..... 355/244
4,855,788 8/1989 Fujii ..... 271/9 X
4,857,963 8/1989 Sutou ..... 355/321
4,864,368 9/1989 Muramatsu ..... 355/309
4,866,487 9/1989 Ohuchi et al. ..... 355/318 X
4,945,390 7/1990 Hasegawa et al. ..... 355/318 X

FOREIGN PATENT DOCUMENTS 0118666 7/1983 Japan ..... 355/318
0095530 5/1985 Japan ..... 355/323
0029831 2/1986 Japan ..... 355/318
0230166 10/1986 Japan ..... 355/309

*Primary Examiner*—A. T. Grimley
*Assistant Examiner*—William J. Royer
*Attorney, Agent, or Firm*—Burns, Doane, Swecker & Mathis

[57] ABSTRACT

An image forming system carries out a simplex recording operation for forming an image on one side of recording paper and discharge the paper onto a discharge tray, and a composite or duplex recording operation in which image-carrying recording paper is formed with a further image on the same image-carrying side or a reverse side prior to discharge. This system includes a paper refeeding device for temporarily storing the recording paper after the simplex recording and refeeding the recording paper to an image forming device for recording a second image thereon, and a mode selector for selecting between a page arranging mode and a non-page arranging mode. The recording paper is discharged directly onto the discharge tray when the non-page arranging mode is selected. On the other hand, when the page arranging mode is selected, the recording paper is transported through the paper refeeding device and recording section and out to the discharge tray.

20 Claims, 7 Drawing Sheets

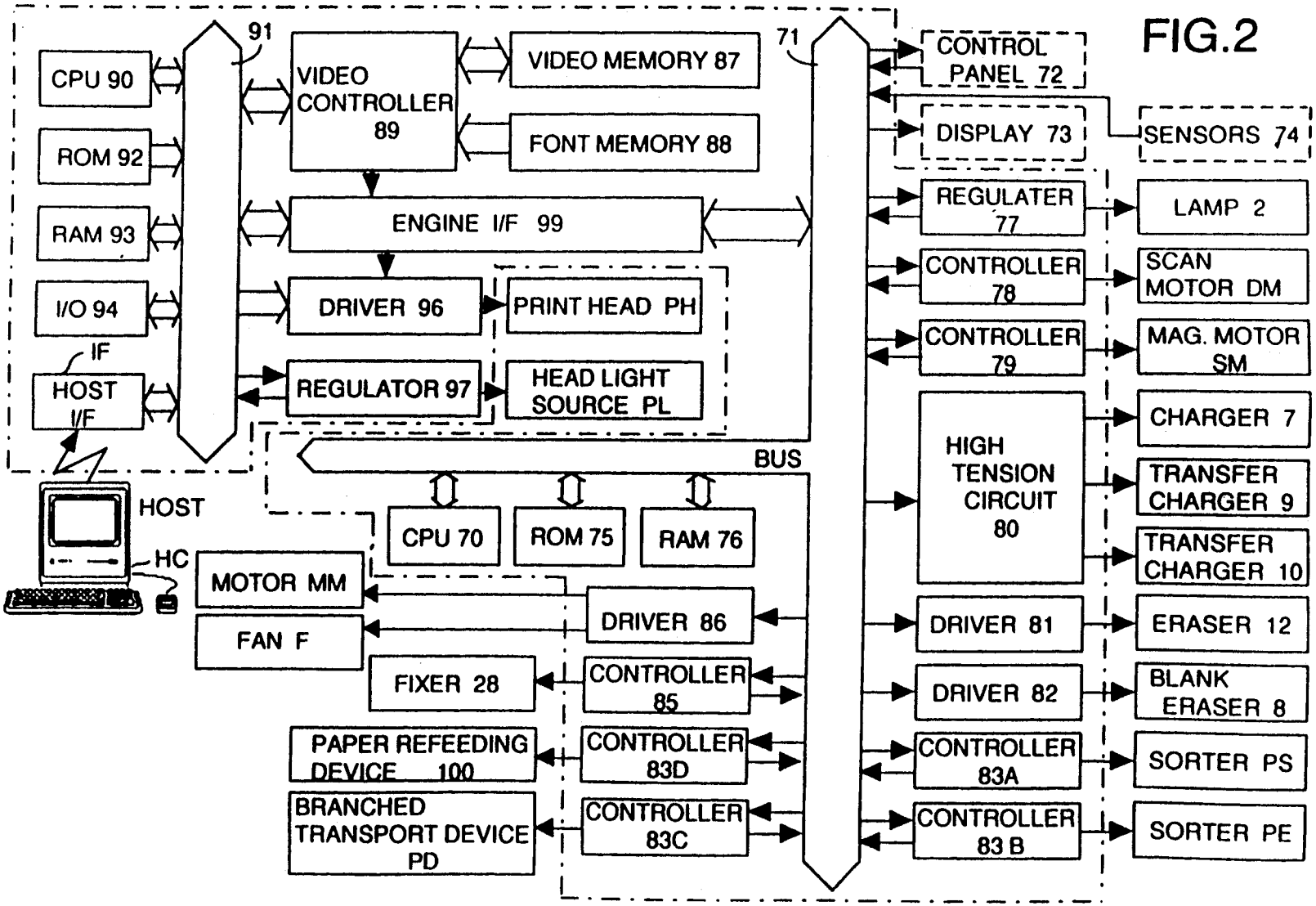
FIG.2
SENSORS 74
LAMP 2
SCAN MOTOR DM
MAG. MOTOR SM
CHARGER 7
TRANSFER CHARGER 9
TRANSFER CHARGER 10
ERASER 12
BLANK ERASER 8
SORTER PS
SORTER PE
CONTROL PANEL 72
DISPLAY 73
REGULATER 77
CONTROLLER 78
CONTROLLER 79
HIGH TENSION CIRCUIT 80
DRIVER 81
DRIVER 82
CONTROLLER 83A
CONTROLLER 83 B
71
BUS
VIDEO MEMORY 87
FONT MEMORY 88
ENGINE I/F 99
PRINT HEAD PH
HEAD LIGHT SOURCE PL
RAM 76
ROM 75
CPU 70
DRIVER 86
CONTROLLER 85
CONTROLLER 83D
CONTROLLER 83C
VIDEO CONTROLLER 89
DRIVER 96
REGULATOR 97
FIXER 28
PAPER REFEEDING DEVICE 100
BRANCHED TRANSPORT DEVICE PD
MOTOR MM
FAN F
91
CPU 90
ROM 92
RAM 93
I/O 94
IF
HOST I/F
HOST
HC

IMAGE FORMING SYSTEM FOR PERFORMING SIMPLEX AND DUPLEX RECORDING

TECHNICAL FIELD

The present invention relates to recording systems such as copying machines and printers for recording images corresponding to original images or input information on recording paper.

BACKGROUND OF THE INVENTION

Recording systems as noted above include indirect electrostatic copying machines utilizing an electrophotographic process, and optical printers such as LED printers. In this type of recording system, generally, the toner transferred to recording paper in the electrophotographic process is maintained in an unfixed condition until the recording paper reaches a fixing device. In order to avoid the necessity to provide a special means for toner adhesion, the recording paper is transported to the fixing device with the recorded side facing up. The recording paper is discharged in the same face-up state after the fixing process. The recording paper thus discharged is stacked with new sheets successively overlying preceding sheets.

According to this arrangement, however, when recording information spanning a plurality of pages is recorded on separate sheets of recording paper, new sheets are successively placed on preceding sheets with their recorded sides facing up. With a machine constructed to start recording the first page of information, the order of page numbering becomes reverse of the proper order of recording information. This requires a manual operation after a recording operation for rearranging the sheets to put the pages in an ascending order from top to bottom.

This rearranging operation is the more troublesome the greater the number of pages of recorded information is. There are recording systems having means for dispensing with the manual rearrangement. One such system includes a reversing device for discharging recording paper face down after a recording operation, thus in the order of page numbering. There is also a type of printer which includes a memory for storing an entire piece of input recording information spanning a plurality of pages, and starts recording the part of the information corresponding to the final page. With this type of printer, therefore, recording paper is discharged face down already in the order of page numbering.

On the other hand, various functions are added to the foregoing recording systems besides the page arranging function in order to promote value added performance.

One of such additional functions is a composite recording function. This function, for example, allows a copying machine to record images of different documents on the same face of a single sheet of recording paper. Further, with this function, a recording system referred to as a digital/analog copier which has both a digital function for recording input recording information dot by dot and an analog function for copying documents can add character or other information to the recording paper on which the image of a document has been formed. To fulfill the composite recording function, a known recording system comprises a paper feeding device for supplying recording paper to a recording section, an image forming device for forming images on the recording paper, a discharge device for discharging the recording paper after the image formation, an intermediate tray for storing plural sheets of recording paper, a branched transport device for feeding the sheets of recording paper after the image formation to the intermediate tray and stacking them face down thereon, and a paper refeeding device for supplying the recording paper from the intermediate tray to the recording section. These paper feeding device, image forming device, branched transport device, paper refeeding device and paper discharge device are operable in response to a composite recording start signal and a recording resume signal. That is, with the composite recording start signal, the recording paper is supplied to the recording section for image formation thereon. Thereafter the recording paper is transported to the intermediate tray. Then, with the recording resume signal, the recording paper is fed from the intermediate tray to the recording section for a further image formation, the paper being discharged subsequent thereto.

Another added function is a duplex recording function. This function, for example, allows a copying machine to record images of different documents on opposite faces of a single sheet of recording paper. Further, with this function, a digital/analog copier having both the digital function for recording input recording information dot by dot and the analog function for copying documents can add character or other information to the reverse side of the recording paper on which the image of a document has been formed. A construction for fulfilling this function is substantially the same as the construction for the composite recording function, and its description is not repeated.

The above known systems with the page arranging function have the following problems.

In the system including the paper reversing device, this device occupies a large space for turning over the recording paper. As a result, the system must have a large overall construction, particularly if the reversing device is provided in addition to an existing paper face-up discharge device. With a printer which simply records input information, compactness may be possible to some extent with an arrangement for stacking recording paper discharged after being reversed by the reversing device on a tray or the like mounted on a top surface of the printer. However, with a copying machine or a digital-analog copier, such a discharge arrangement cannot be employed since a document table is provided on the top surface of the machine. It is especially difficult to provide such a machine with the paper reversing device without the problem relating to space.

Regarding the recording system including a memory for storing information spanning a plurality of pages to start printing the final page, the number of pages of recording information constituting one document is variable and sometimes exceeds one hundred. This means that, in order to realize the page arrangement, a large capacity memory is required to meet the rare recording conditions in which information is recorded on a great number of pages. Such a construction only impairs cost performance and is not practicable. Moreover, such a construction cannot be applied to an ordinary copying machine.

It is also desired for the recording system having the composite and/or duplex recording functions to output recorded sheets in page arrangement. However, a construction such as the foregoing reversing device simply added to realize the page arranging function is futile since it not only complicates the system construction but consumes a very long time in recording information on a large number of sheets.

SUMMARY OF THE INVENTION

Having regard to the above state of the art, an object of the present invention is to provide a compact and inexpensive recording system which effectively utilizes a construction for composite recording to be capable of outputting recorded information in the order of page numbering easily and speedily.

The above object is fulfilled, according to the present invention, by a recording system as described in the outset hereof wherein recording paper carrying an image formed on one side thereof by the image forming device is transported through the image forming device again by the paper refeeding device and discharged onto the discharge tray, the image forming device being inoperative when the recording paper fed by the paper refeeding device passes therethrough.

This system may have various specific constructions for enabling the composite recording and/or duplex recording, and their features along with the other objects and advantages of the invention will be apparent from the following more particular description of preferred embodiments of the invention, as illustrated in the accompanying drawings.

BRIEF DESCRIPTION OF THE DRAWINGS

FIG. 2 is a block diagram of a control system.

DESCRIPTION OF THE PREFERRED EMBODIMENTS

First Embodiment

A first embodiment of the present invention will be described hereinafter.

Figure 1:
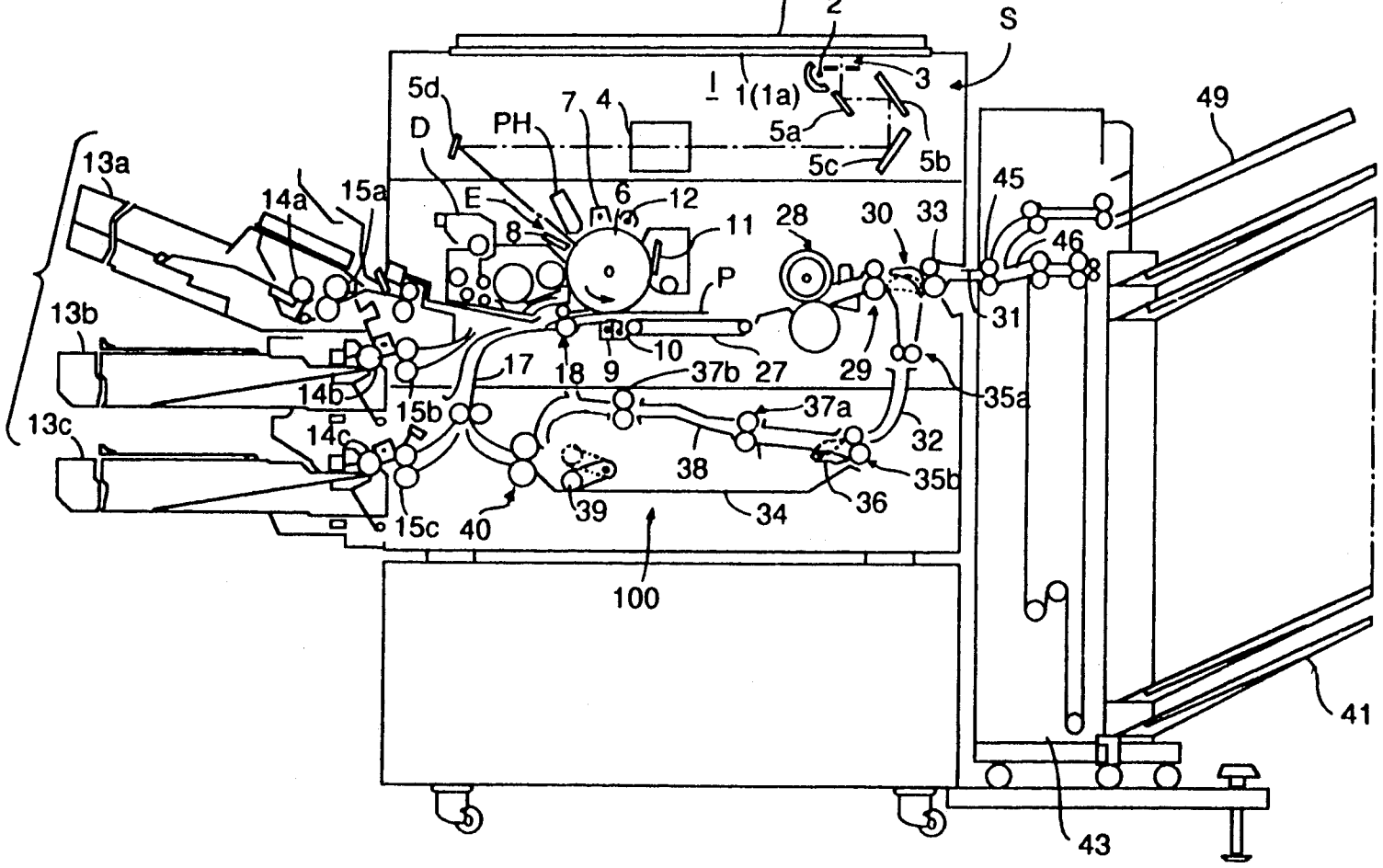
FIG. 1 is a schematic sectional view of a recording system in a first embodiment of the present invention.

FIG. 1 is a sectional view of a slit scan type electrophotographic recording system which is one example of recording systems according to the present invention.

This recording system comprises a document table 1 formed of a glass plate 1*a*, and an exposure lamp 2 for illuminating an original document M placed on the glass plate 1*a*. Light reflected from the document M passes through a slit 3 to be projected onto a photoreceptor drum 6 by an image forming optical system I including an image forming lens 4 and a plurality of mirrors 5*a*–5*d*. The drum 6 is rotatable at a peripheral velocity V counterclockwise in FIG. 1.

The exposure lamp 2, slit 3 and first mirror 5*a* constitute a scanning device S which is driven to scan the document M leftward in FIG. 1 at a velocity V/n (where n is a ratio of copying magnification). The second mirror 5*b* and third mirror 5*c* are movable leftward in FIG. 1 at half the velocity V/2 n of the scanning device S, so that the image forming optical system I maintains a fixed length of image forming optical path.

The light reflected from the document M scanned by the scanning device S impinges on the photoreceptor drum 6. Electric charges applied uniformly over the surface of the drum 6 are selectively erased in accordance with the image-carrying light, thereby forming an electrostatic latent image on the drum surface.

The image forming lens 4 and fourth mirror 5*d* are driven by a motor to move right and left in FIG. 1. This movement changes the conjugate length of image forming optical system I, thereby varying copying magnification in a direction perpendicular to a scanning direction. When the image forming lens 4 and fourth mirror 5*d* are moved to set copying magnification to a ratio other than "1", the scanning velocity of the scanning device S is varied correspondingly, which varies copying magnification in the scanning direction. Thus, the image of document M placed on the document table 1 may be enlarged or reduced with a selected magnification ratio by varying the position of image forming lens 4 and fourth mirror 5*d* as well as the scanning speed.

The photoreceptor drum 6 is surrounded by a charging device 7 for uniformly charging the drum surface, an exposure station E at which the photoreceptor drum 6 is exposed to the light reflected from the document M for forming an electrostatic latent image thereon, a blank eraser 8 for removing an unnecessary electric charge from the photoreceptor drum 6, a developing device D for applying toner to the electrostatic latent image on the photoreceptor drum 6 to develop the latent image into a visible image, a transfer device 9 for transferring the toner image from the drum 6 to recording paper P, a separating device 10 for separating the recording paper P from the drum 6, a blade-like cleaning device 11 for removing excess toner adhering to the drum 6 after the image transfer, and a main eraser 12 for erasing the charge from the drum 6 after the image transfer.

The recording system further comprises an optical printing head PH disposed between the blank eraser 8 and developing device D for forming an electrostatic latent image on the drum 6 in response to recording information input from outside.

Figure 3:
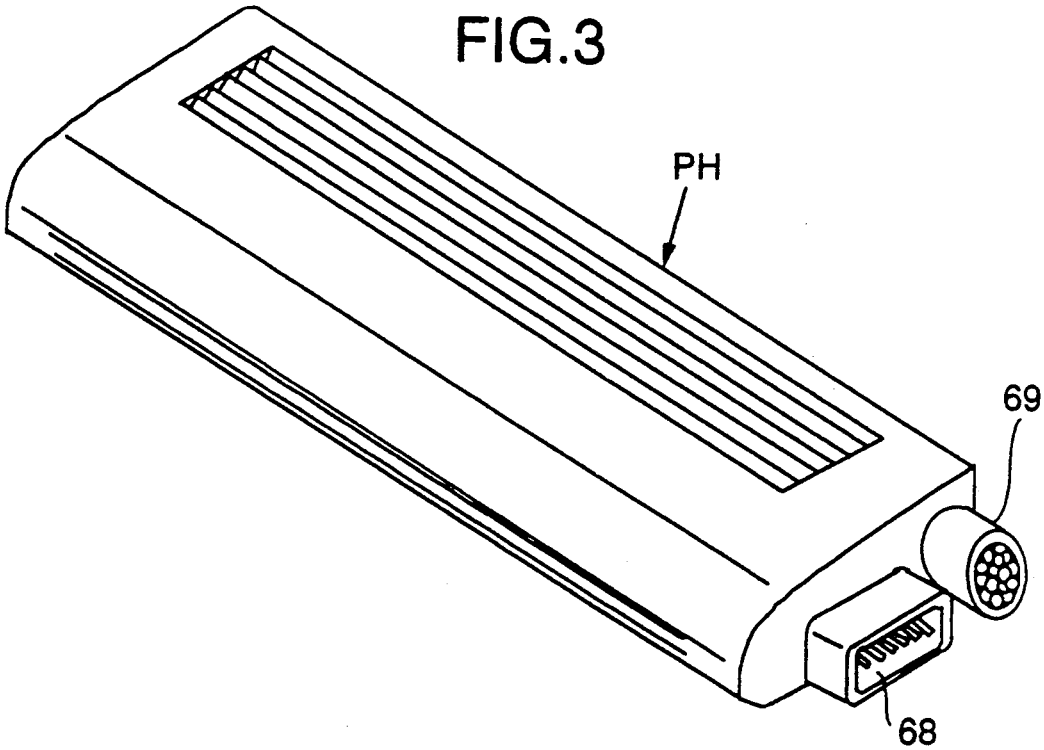
FIG. 3 is a perspective view of an optical printing head.
Figure 4:
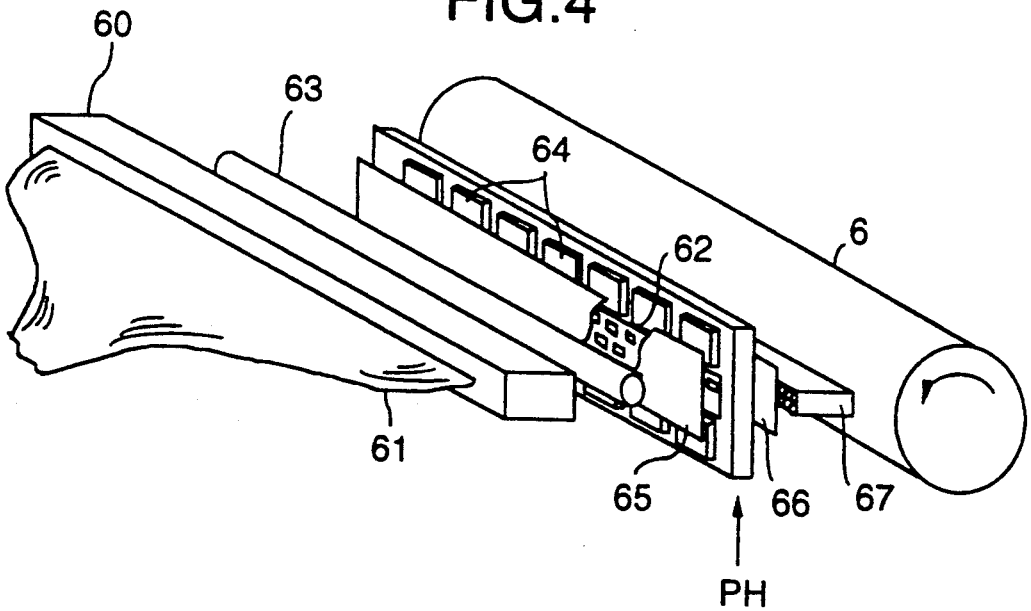
FIG. 4 is a perspective view of an interior of the optical printing head.
Figure 5:
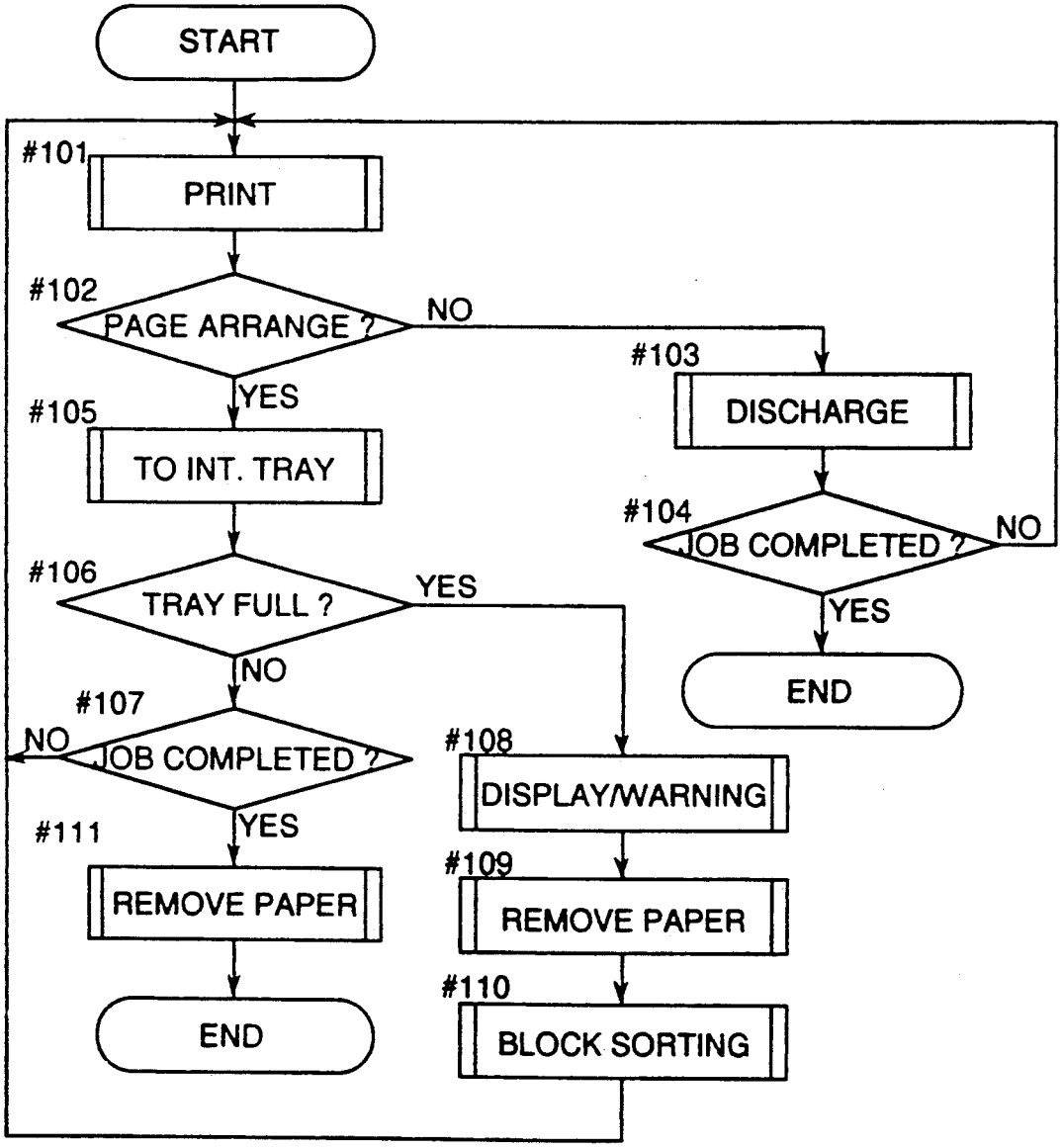
FIG. 5 is a flowchart of an operation of the recording system.

As shown in FIGS. 3 and 4, the optical printing head PH includes a plurality of optical fibers 61 for leading light from a light source (not shown) to a linear light emitter 60. The light emitted uniformly from the light emitter 60 is condensed by a rod lens 63 for impingement onto a PLZT shutter array 62 having a pixel-to-pixel coverage. Each shutter of the PLZT shutter array 62 is driven by a driver circuit 64. Opposed across the PLZT shutter array 62 are a polarizer 65 and an analyzer 66 having polarizing directions perpendicular to each other. A light beam having passed through each shutter of the PLZT shutter array 62 is condensed by a rod lens array 67 onto the photoreceptor drum 6.

When printing an image corresponding to the recording information input from outside by means of the optical printing head PH, the shutters of the PLZT shutter array 62 are selectively driven by the driver circuits 64 in response to the recording information input through a connector 68 from an input information storing memory which will be described later. Only those light beams having passed through the shutters in an operative state for rotating the polarizing directions are allowed to travel through the analyzer 66 to impinge on the photoreceptor drum 6. As a result, an electrostatic latent image corresponding to the recording information is formed on the drum 6. Reference numeral 69 in FIG. 3 denotes an optical fiber connector for inputting the light from the light source to the optical fibers 61 inside the printing head PH.

Reverting to FIG. 1, the electrostatic latent image formed by the printing head PH on the photoreceptor drum 6 is developed by the developing device D and then reaches the transfer device 9 with the rotation of the drum 6, as in the case of the image resulting from the light transmitted from the original document M on the document table 1 by the scanning device S and the image-forming optical system I.

Sheets of the recording paper P in three different sizes are stored in sheet feed trays 13*a*, 13*b* and 13*c*, respectively, which are removably attached to a main body of the recording system. The recording paper P of a designated size is picked up from the tray 13*a*, 13*b* or 13*c* one sheet after another by a pickup roller 14*a*, 14*b* or 14*c*. Then the paper P advances through a control roller pair 15*a*, 15*b* or 15*c* to a paper feed passage 17. Thereafter the paper P reaches a timing roller pair 18 which feeds the paper P to the transfer device 9 in synchronized relationship with formation of an electrostatic latent image on the photoreceptor drum 6.

The construction for supplying the recording paper P from the paper feed trays 13*a*, 13*b* and 13*c* to the transfer device 9 forms a paper supplying device PS.

The recording paper P, having received the toner image from the photoreceptor drum 6 at the transfer device 9 and separated from the drum 6 by the separating device 10, is transported by a conveyer belt 27 to a fixing device 28. The fixing device 28 fixes the toner image to the recording paper P by heating and fusing the toner.

Thus, the transfer device 9 through the fixing device 28 constitute a recording section. The scanning device S, image forming optical system I, optical printing head PH, photoreceptor drum 6, elements 7-12 surrounding the drum 6, paper supplying device PS, conveyer belt 27, fixing device 28, and a control system described later, constitute an image forming device for forming images on the recording paper P fed to the recording section.

The recording paper P having passed through the fixing device 28 is drawn therefrom by a transport roller pair 29, and is guided to a first switch lever 30 for switching transport directions in accordance with copying and printing conditions. The switch lever 30 is operable to direct the recording paper P to a paper discharge passage 31 leading outwardly of the main body, or to a bypass passage 32 leading to an inlet of the transfer device 9.

Specifically, the first switch lever 30 switches the transport of recording paper P as follows:

When a single original document M is copied onto one side of the recording paper P (which operation is hereinafter referred to as the "simplex copying mode") or when only one hard copy is output (which operation is hereinafter referred to as the "single printing mode"), the first switch lever 30 is moved to a position to guide the recording paper P from the fixing device 28 to the discharge passage 31. This position setting is made regardless of copying conditions such as copying magnification ratios and the number of copies, and printing conditions such as the number of prints. As a result, the recording paper P is discharged face up by a discharge roller pair 33 outwardly of the main body. The construction for setting the first switch lever 30 to the position to discharge the recording paper P forms a paper discharging device.

The first switch lever 30 is moved to a position to guide the recording paper P from the fixing device 28 to the bypass passage 32 when one or two original documents M is/are copied onto both sides of the recording paper P (which operation is hereinafter referred to as the "duplex copying mode"), when parts of the document or documents are copied in combination onto one side of the recording paper P (which operation is hereinafter referred to as the "composite copying mode"), when the recording paper P carrying a duplicate image of a document M is printed with other information by means of the optical printing head PH (which operation is hereinafter referred to as the "composite printing mode"), or when images are recorded on a plurality of sheets with pages thereof arranged in the ascending order from top to bottom (which is hereinafter referred to as the "page arranging mode"). As a result, the recording paper P is delivered to an intermediate tray 34 to be described later.

The construction for setting the first switch lever 30 to the position to direct the recording paper P to the intermediate tray 34 forms a branched transport device.

The intermediate tray 34 is disposed forwardly of the bypass passage 32 for temporarily storing the recording paper P guided into the bypass passage 32. In the composite copying, composite printing and page arranging modes, the recording paper P is delivered to the intermediate tray 34 by two transport roller pairs 35*a* and 35*b*. In the duplex copying mode, the recording paper P is guided by a second switch lever 36 disposed at a position just short of the intermediate tray 34, to proceed into a reversing passage 38 including two transport roller pairs 37*a* and 37*b*. In this case, the recording paper P is delivered to the intermediate tray 34 after being turned over by the reversing passage 38.

The recording paper P is picked up, starting with the top sheet, from the intermediate tray 34 by a pickup roller 39 with commencement of a copying operation for the second side in the case of the duplex copying mode or commencement of a second copying or printing operation in the case of the composite copying or printing mode. The recording paper P then passes through a control roller pair 40, and enters the paper feed passage 17 leading to the transfer device 9.

The above construction forms a paper refeeding device 100 for feeding the recording paper P from the intermediate tray 34 to the recording section.

In the duplex copying mode, composite copying mode and composite printing mode, the recording paper P is fed to the transfer device 9 under the synchronizing control by the timing roller pair 18 to have a toner image transferred thereto from the photoreceptor drum 6 as in the simplex copying and single printing modes. Subsequently, the toner image is fixed to the recording paper P by the fixing device 28, and the recording paper P is discharged outwardly of the main body through the discharge passage 31 having the discharge roller pair 33.

In the page arranging mode, the paper refeeding device 100 is not operated till a plurality of pages have been recorded. The recording paper P carrying printed images on one side thereof is delivered by the branched transport device to the intermediate tray 32 and stacked face down thereon. When all the information has been printed on one side of the recording paper P, only the paper refeeding device and paper discharge device are operated in response to a recording completion signal to pick up, successively from the top sheet downward, the plural sheets of recording paper P stacked on the intermediate tray 34 and discharge the sheets outwardly of the main body. When the number of pages to be recorded exceeds the capacity of the intermediate tray 34, the recording operation is interrupted for removing the recording paper P from the intermediate tray 34. The recording operation is resumed upon completion of paper removal from the intermediate tray 34.

A sorter 43 is disposed laterally of the main body in opposed relationship to the discharge passage 31. The sorter 43 includes paper discharge bins 41 in 20 stages for storing, in groups, plural sheets of recording paper P discharged from the main body. The sorter 43 further includes an intake roller pair 45 opposed to the discharge roller pair 33 of the main body, a distributing passage 46 vertically pivotable for delivering the sheets of recording paper P to appropriate bins 41, and a discharge tray 49 for receiving the recording paper P when the latter is not sorted or grouped by means of the bins 41.

The sheets of recording paper P discharged from the main body pass through the intake roller pair 45 of the sorter 43. Thereafter the sheets are delivered through the distributing passage 46 of the sorter 43 to the bins 41, or discharged onto the discharge tray 49.

The information to be recorded is prepared by a recording information output device HC such as a host computer or a word processor connected to this electrophotographic recording system through an interface IF as shown in FIG. 2. When the information to be recorded comprises character information input through a keyboard or stored in a built-in document memory, such information is transmitted as character codes to the control system C of the electrophotographic recording system. When the information to be recorded comprises image information, such information is transmitted as dot data to the control system C of the electrophotographic recording system.

The control system C includes a first CPU 70 for controlling the document scan in the copying operation and an overall electrophotographic process in the copying and printing operations, and a second CPU 90 for controlling writing of recording information in the printing operation.

The first CPU 70 determines copying conditions in response to inputs made through various keys on a control panel 72 and transmitted by way of a first bus 71, and causes the conditions to be displayed on a display panel 73. Further, the first CPU 70 receives output signals through the first bus 71 from various sensors 74 for detecting density of original document M, transport of recording paper P and so on. In addition, a program ROM 75 and a data RAM 76 are connected to the first CPU 70 through the first bus 71.

Based on the control signals received through the first bus 71, the first CPU 70 actuates a regulator 77 for controlling the exposure lamp 2, a controller 78 for controlling a DC motor DM to drive the scanning device S, a controller 79 for controlling a stepper motor SM to vary the conjugate length of the image forming optical system I to vary magnification ratios, a high voltage driver circuit 80 for controlling the charging device 7, transfer device 9 and separating device 10, a driver circuit 81 for driving the main eraser 12, a driver circuit 82 for driving the blank eraser 8, controllers 83A–83D for controlling the paper feeding device PS, discharge device PE, branched transport device PD and paper refeeding device 100, respectively, a controller 85 for controlling temperature of the fixing device 28, and a driver circuit 86 for driving a main motor MM and cooling fans F.

The second CPU 90 receives control signals along with recording information from the recording information output device HC through the interface IF and a second bus 91, and control signals from the control panel 72 through the first and second buses 71 and 91 and an interface 99 disposed therebetween. The second CPU 90 determines recording conditions from these control signals, and gives corresponding displays on the display panel 73. The second CPU 90 also receives predetermined output signals from the various sensors 74. Further, a program ROM 92, a data RAM 93, and an I/O port 94 for communicating signals with external devices are connected to the second CPU 90 through the second bus 91.

In response to the control signals received through the second bus 91, the second CPU 90 actuates a driver circuit 96 for driving the shutter driver circuits 64 of the optical printing head PH, a regulator 97 for controlling a light source PL of the printing head PH, and a video controller 89 for controlling input and output of recording information. When a recording operation is carried out through the image forming device based on input recording information, the second CPU 90 transmits control signals to the first CPU 70 through the second bus 91, interface 99 and first bus 71, thereby actuating the various devices taking part in the electrophotographic process in synchronism with writing of recording information by the optical printing head PH.

The video controller 89 develops recording information received from the external recording information output device HC on a video memory 87 of the bit map type having a storage capacity for one page for storing the input recording information as dot data. If this information comprises image information in dots, the information is stored as it is. If the information comprises character information, the video controller 89 reads font data in dots corresponding to respective character codes from a font memory 88, and thereafter develops the information on the video memory 87. Upon receipt of a recording request signal from the second CPU 90, the video controller 89 reads the recording information from the video memory 87 in a fixed order. Further, the video controller 89, based on the recording information, controls operations of the shutter driver circuits 64. The shutters of the optical printing head PH corresponding to the pixels, respectively, are thereby driven to form an electrostatic latent image on the photoreceptor drum 6 in accordance with the recording information.

The controller 78 for controlling the DC motor DM causes the scanning device S to move forward, return and stop in response to forward and backward drive control signals output from the first CPU 70. This controller 78 also receives a shaped pulse signal from an optical encoder attached to the DC motor DM, and transmits the pulse signal to the first CPU 70. On the basis of this signal, the first CPU 70 determines a position of the scanning device S.

The controller 79 connected to the stepper motor SM for driving the image forming optical system I is operable in response to drive control signals received from the first CPU 70, for driving the image forming lens 4 and fourth mirror 5*d* back and forth to establish a conjugate length providing a selected magnification ratio.

The second CPU 90 outputs recording conditions such as a designated magnification ratio, a selected size of copying paper and the number of prints, and a print request signal to the first CPU 70, and the latter carries out the corresponding processing.

In carrying out a recording operation in the page arranging mode, the first CPU 70 automatically effects a page arrangement by actuating the controllers 83A–83D for controlling the paper feeding device PS, paper discharge device PE, branched transport device PD and paper refeeding device 100, and the controllers for controlling various devices constituting the image forming device.

To described these controls more particularly, when a print key is pressed with the page arranging mode selected, the paper feeding device PS is operated in response to a page arranging recording signal, thereby to supply recording paper P from the paper supply section 13 to the recording section. Then the image forming device is operated to form an image corresponding to a document M or input recording information on the recording paper P. Thereafter the branched transport device PD is operated to feed the image-carrying recording paper P to the intermediate tray 34. The above operation is repeated for recording a plurality of pages in an ascending order. As a result, the sheets of recording paper P are successively stacked face down on the intermediate tray 34, in the ascending order from bottom to top.

Upon completion of the recording operation for all the pages, the paper refeeding device 100 is actuated to pick up the plural sheets of recording paper P stacked faced down on the intermediate tray 34, starting with the top sheet, and deliver the sheets to the recording section. At this time, the first CPU 70 stops the operation of the image forming device, and allows the recording paper P to pass through the recording section without being formed with an image, and actuates the discharge device PE to discharge the recording paper P onto the discharge tray 49. Since the sheets of recording paper P are discharged with the image-carrying sides facing up, the sheets of recording paper P as discharged onto the discharged tray 49 are arranged in a proper order of page numbering, which is achieved by picking up and discharging, from top to bottom, the plural sheets of recording paper P in the face-down page arrangement on the intermediate tray 34.

The above construction forms a removing device for picking up the plural sheets of recording paper P stacked on the intermediate tray 34 while retaining the order in which the sheets are stacked.

When the total number of pages to be recorded exceeds the number of sheets of the recording paper P storable on the intermediate tray 34, the first CPU 70 discontinues the recording operation and notify the user that the intermediate tray 34 is full by an indication on the display panel 73 and by sounding a buzzer. Subsequently, the removing device is operated to discharge the plural sheets of the recording paper P onto the discharge tray 49. When removal of the recording paper P from the intermediate tray 34 has been confirmed through detection by a paper sensor provided on or adjacent the intermediate tray 34, for example, a sheet of recording paper P having a different size is discharged onto the batch of recording paper P to distinguish it from a next batch of recording paper P (which is called block sorting). Then the suspended recording operation is resumed. Since the entire information is divided into a plurality of batches by blank sheets of recording paper P having a different size, the user may only have to put those batches in order after the entire information has been recorded. The block sorting may be effected by inserting the same size recording paper having a different color between batches. Where the recording system has a grouping or gathering sorter, the recording paper P may be discharged successively to the plurality of sorting bins.

Reverting to the block diagram of FIG. 2, the first CPU 70 and second CPU 90 automatically restore standard copying or printing conditions if a copying or printing operation is not effected under prevailing conditions before lapse of a predetermined time (e.g. three minutes) from setting of the above specific copying or printing conditions or from completion of a copying or printing operation carried out under those conditions. This is called an auto reset function.

In the single and other printing modes and in the simplex and other copying modes, the various devices are switchable by the control signals output from the first CPU 70 and second CPU 90. The resulting states of these devices are set out in Table 1 below. In the table, "ON" represents an operative state and "OFF" an inoperative state.

TABLE 1

| Modes of Operation | Recording | Copying |
|---|---|---|
| Charging Device 7 | ON | ON |
| Printing Head PH | ON | OFF |
| Scanning Device S | OFF | ON |
| Developing Device D | ON | ON |
| Transfer & Separating | ON | ON |
| Devices 9 and 10 | ON | ON |
| Cleaning Device 11 | ON | ON |
| Main Eraser 12 | ON | ON |
| Fixing Device 28 | ON | ON |

Figure 6:
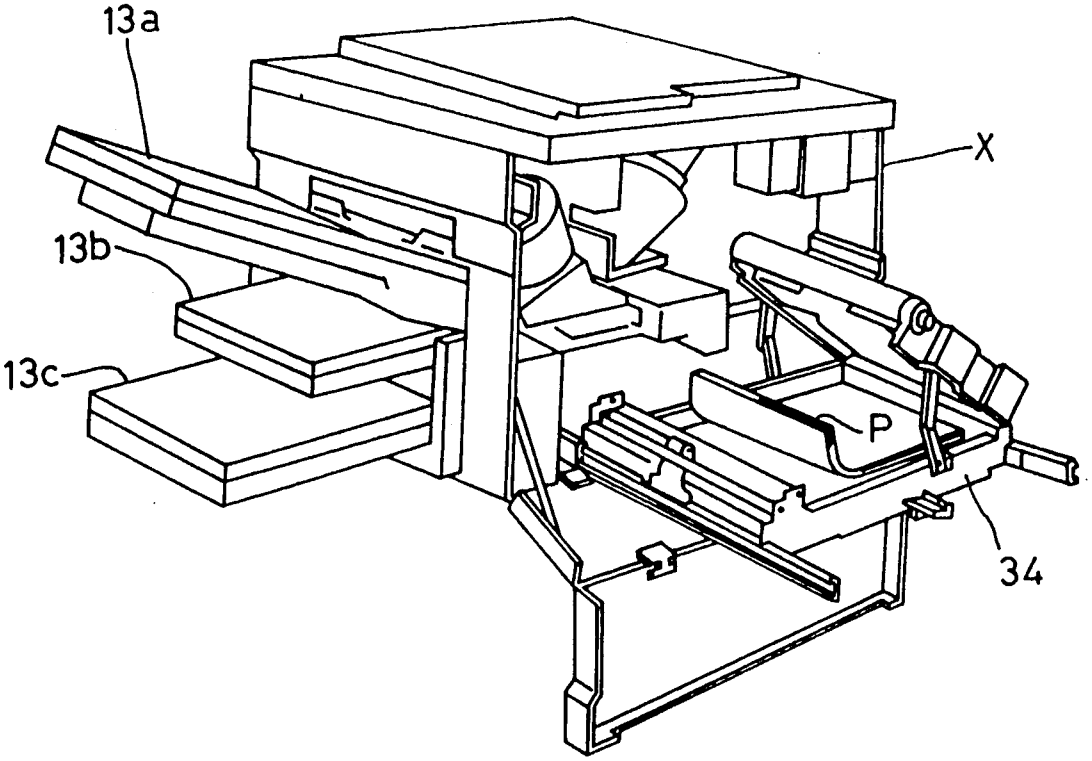
FIG. 6 is a perspective view of a recording system in a second embodiment of the invention.

FIG. 6 is a flowchart showing a basic sequence in which the this electrophotographic recording system carries out a recording operation in the page arranging mode to output printed sheets of the recording paper P in the order of page numbering.

When a recording operation is started, the paper feeding device and image forming device are actuated at step #101 to form an image on the recording paper P. If page arrangement is not required, the recording paper is discharged onto the discharge tray 49 (steps #102 and #103). This operation is repeated until all the information is recorded (which is called a job) (step #104). If page arrangement is required, the image-carrying recording paper P is delivered to the intermediate tray 34 (steps #102 and #105). This operation is repeated until the intermediate tray 34 becomes full (step #106) or the job is completed (step #107).

If, in the course of one job, the intermediate tray 34 is found full at step #106, the program moves to step #108 for giving a display and warning to that effect, step #109 for removing the recording paper P from the intermediate tray 34, and step #110 for block sorting, and then back to step #101 for resuming the recording operation. If the recording operation comes to an end before the intermediate tray 34 becomes full (step #107), the program executes step #111 to remove the recording paper P from the intermediate tray 34 and finishes this sequence.

A modification of the first embodiment will be described hereinafter.

In the page arranging mode described above, the recording paper is discharged face up in the order of page numbering onto the discharge tray. In this modification, the recording paper is discharged face down in the order of page numbering. That is, the recording paper is discharged in the order of page numbering so that an image-carrying side of a succeeding sheet contacts a reverse side of a preceding sheet. To realize this mode, the recording paper having left the recording section is turned over an even number of times before being stacked sheet after sheet on the intermediate tray 34. The recording paper stacked on the intermediate tray 34 is picked up in an order from the bottom sheet upward (i.e. first-in first-out). The sheets are then turned over an odd number of times, allowed to pass straight through the recording section and discharged onto the discharge tray.

Second Embodiment

The second embodiment differs from the first embodiment in the construction of the removing device, and may take the following two forms:

(1) In the first embodiment, the removing device is automatically operable either when a job is completed or when the intermediate tray 34 becomes full. Alternatively, only when the intermediate tray 34 becomes full or in either case, the removing device may wait for a manual operation by the user to press the paper discharge key or the like. A control device may of course be provided for a manual removal of the recording paper P where the removal of the recording paper P is automatically carried out as in the first embodiment.

(2) The removing device in the first embodiment utilizes the paper refeeding and discharging constructions of the recording system. Instead, part of the intermediate tray 34 may be exposed outwardly of the main body of the recording system by opening a cover, for allowing a batch of recording paper P to be recovered from the intermediate tray 34. As shown in FIG. 6, the entire intermediate tray 34 may be movable into and out of the main body X for allowing a batch of recording paper P to be taken out. In this construction, the paper refeeding device PR may pickup the recording paper P from the intermediate tray 34 from the top sheet or from the bottom sheet.

Third Embodiment

In this embodiment, as distinct from the preceding embodiments, the recording paper exiting the recording section is transported to the intermediate tray 34 for page arranging purposes, but is transported further onward without being stacked thereon and allowed to pass through the recording section at an appropriate time and to be discharged onto the discharge tray 49.

Figure 7:
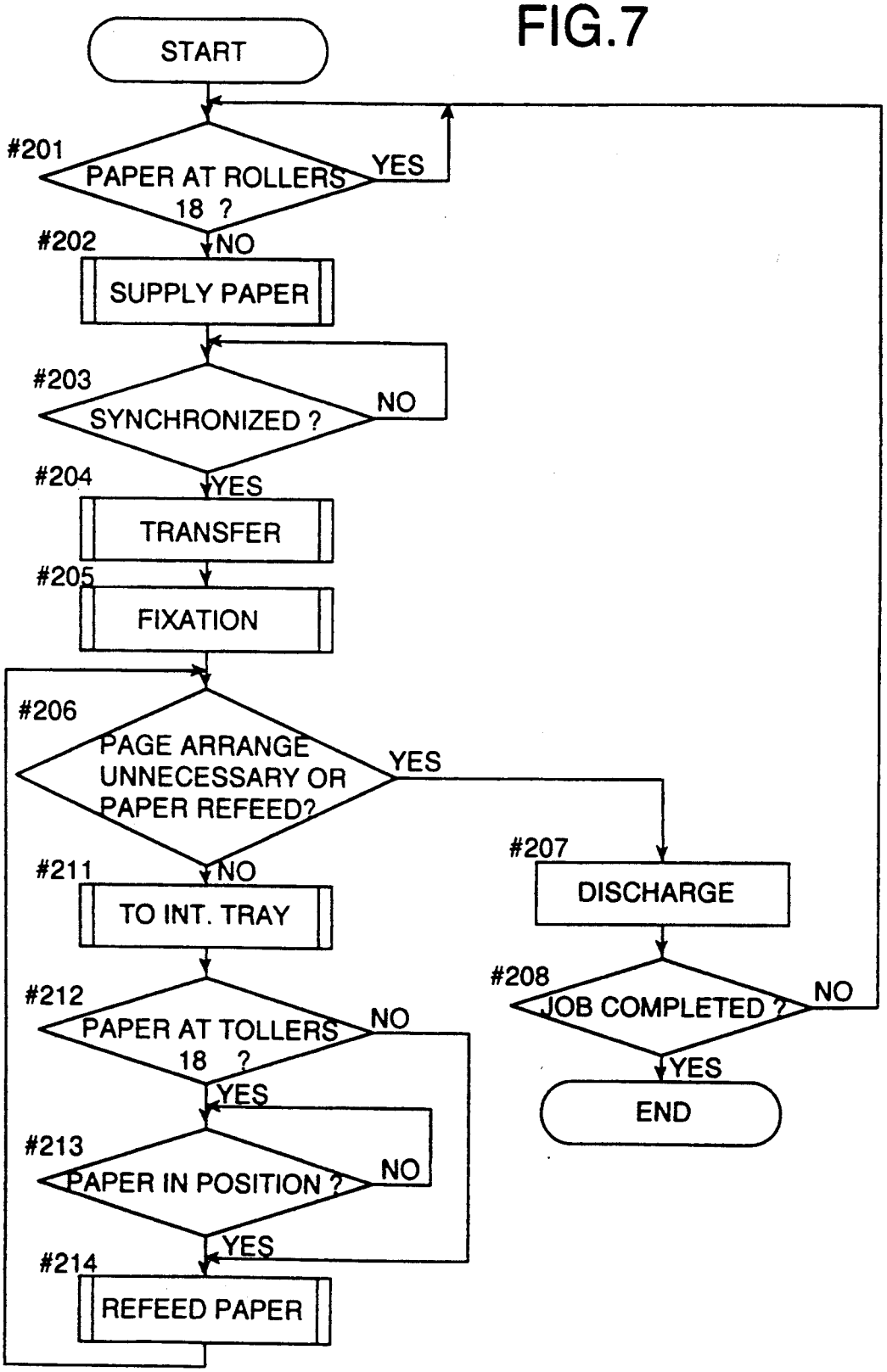
FIG. 7 is a flowchart of an operation of a third embodiment of the invention.

FIG. 7 shows a basic flowchart of a "page arranging simplex recording" portion of a recording operation in the page arranging mode according to this embodiment.

When the recording operation is started, step #201 is executed to check if there is recording paper P (recording paper refed after image formation) upstream of the timing roller pair 18. If there is no recording paper P or after waiting for any recording paper P present to be transported ahead of the timing roller pair 18, the paper feeding device PS is operated at step #202 to feed recording paper P to the timing roller pair 18. After securing synchronism with formation of an electrostatic latent image on the photoreceptor drum 6 at step #203, the recording paper P is advanced to the transfer device 9 for transfer of a toner image at step #204. Then, at step #205, the recording paper P is forwarded to the fixing device 28 to have the toner image fixed to the recording paper P.

Subsequently, the recording paper P is discharged onto the discharge tray 49 if there is no need for a page arrangement (which includes cases of outputting only one recorded sheet and of thick recording paper P difficult to turn over) or if the recording paper P has been refed in the page arranging simplex recording mode. The above operation is repeated until step #208 finds a series of recording (called a job) completed for a plurality of pages.

In the case of a page arranging simplex recording mode and the recording paper P being freshly fed paper, the paper refeeding device 100 is operated at step #211 to cause the image-carrying recording paper P to pass through the bypass passage 32 and reversing passage 33, whereby the recording paper P is turned over and fed to the intermediate tray 34. At this time, step #212 is executed to check if there is recording paper P (blank paper for next recording) upstream of the timing roller pair 18. If there is no recording paper, the refeeding device 100 is operated at step #214 to pick up the recording paper P from the intermediate tray 34 and send it to the recording section. The refed recording paper P is thereafter allowed to pass through the fixing device 28 and discharged outwardly, without having a toner image transferred thereto at the transfer device 9 (steps #206 and #207). The above operation is repeated until a job is completed.

If step #212 finds fresh recording paper P upstream of the timing roller pair 18 while the image-carrying recording paper P is present on the intermediate tray 34, the program waits at step #213 for the fresh recording paper P to reach the timing roller pair 18. At step #214, the recording paper P is delivered from the intermediate tray 34 to the recording section with a timing based on the size of the fresh recording paper P so that the refed recording paper P does not overlap the fresh recording paper P and no unnecessary gap occurs therebetween. The refed recording paper P is discharged outwardly without having a further image formed thereon (steps #206 and #207). The above operation is repeated until a job is completed.

As described above, the recording system in this embodiment reverses and discharges image-carrying recording paper in a page arrangement by utilizing the paper refeeding device which is included in the construction for carrying out the duplex recording. The reversed recording paper is discharged after being allowed to pass through the recording section without overlapping freshly fed recording paper. Thus, a page arrangement is obtained speedily without requiring a special page arranging mechanism such as a reversing device for turning the recording paper from face-up state to face-down state, or an extensive modification to the internal mechanisms of the recording system.

Fourth Embodiment

This embodiment is similar to the third embodiment, the difference being that, in this embodiment, the timing for feeding the recording paper P to the recording section by the paper refeeding device 100 in the page arranging recording is determined without changing the timing for feeding blank recording paper P by the paper feeding device PS for recording a next page. Thus, when a plurality of pages are successively recorded based on input recording information, image-carrying recording paper P fed by the refeeding device 100 passes through the recording section as underlying blank recording paper P fed by the paper feeding device. At this time, an image is formed on the blank recording paper P by the image forming device.

In this state, two image-carrying sheets of recording paper P are transported as overlapping each other out of the recording section. The two sheets discharged from the recording section are separated so that the sheet fed by the paper refeeding device 100 (hereinafter referred to as refed recording paper P2) is discharged outwardly of the main body X while the sheet fed by the paper feeding device (hereinafter referred to as fresh recording paper P1) is transported through the bypass passage 32 back to the recording section.

Figure 8:
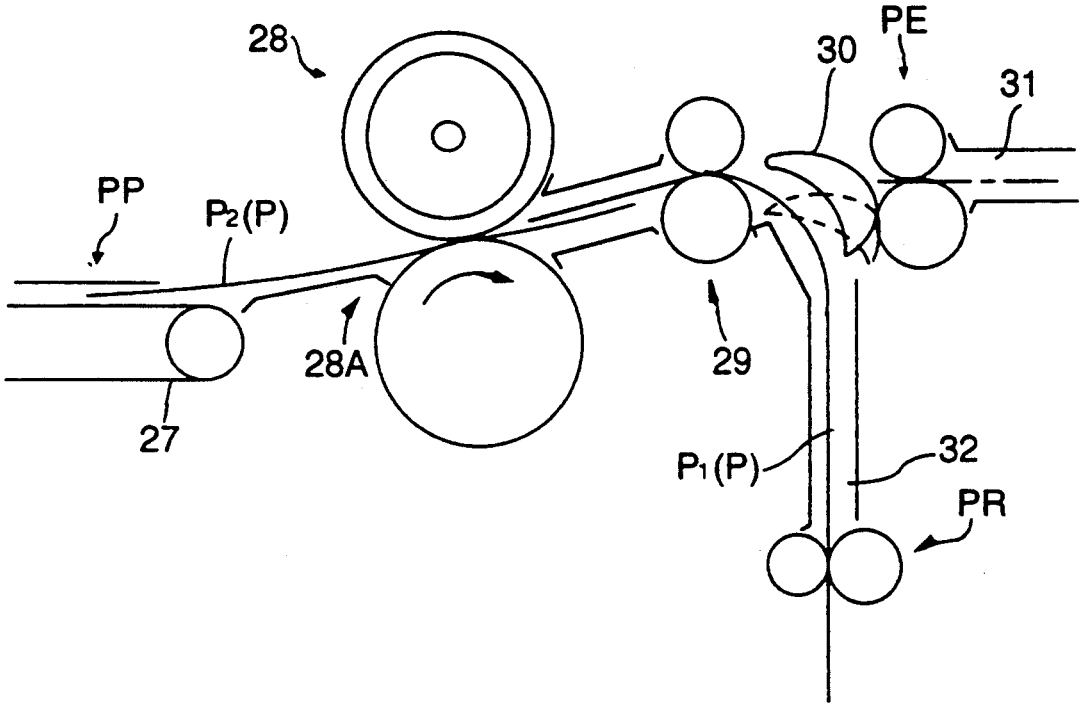
FIG. 8 is a schematic view of a recording paper separating device.

Referring to FIG. 8, the transport roller pair 29 for drawing the recording paper P from the fixing device 28 is rotatable at a higher peripheral speed than a fixing roller pair 28A constituting the fixing device 28. Consequently, of the two overlapping sheets of recording paper P, a leading one is drawn faster than the other, thereby forming a gap between the two sheets. The first switch lever 30 is switched after the leading sheet is fed into the discharge passage 31 or the bypass passage 32 and before the other sheet reaches the first switch lever 30, to feed the latter into the other passage.

To describe this paper transport mode more particularly, FIG. 8 shows the first switch lever 30 in a position indicated by a solid line for forwarding the recording paper P back to the recording section, with the fresh sheet of recording paper P1 lying on top of the other sheet having a forward end thereof extending into the bypass passage 32. As soon as the rear end of the fresh sheet of recording paper P1 becomes free of the nip by the fixing roller pair 28A, this sheet is transported only by the transport roller pair 29 rotating at the higher peripheral speed than the fixing roller pair 28A. Consequently, the fresh sheet P1 is transported faster than and drawn away from the refed sheet P2, thereby forming a gap between the rear end of the fresh sheet P1 and the forward end of the refed sheet P1. After the rear end of the fresh sheet P1 enters the bypass passage 32, the first switch lever 30 is moved to a discharge position shown in the two-dot-and-dash line in FIG. 8. As a result, the refed sheet P2 is transported into the discharge passage 31 for discharge outwardly of the main body.

Subsequently, a next fresh sheet of recording paper P1 reaches the fixing device 28 with a forward end thereof overlying the rear end of the refed sheet P2. As soon as the rear end of the refed sheet P2 becomes free of the nip by the fixing roller pair 28A, this refed sheet P2 is transported at the higher speed by the transport roller pair 29, thereby forming a gap again between the rear end of the refed sheet P1 and the forward end of the fresh sheet P1. After the rear end of the refed sheet P2 enters the discharge passage 31, the first switch lever 30 is moved back to the paper redirecting position. As a result, the next fresh sheet P1 is transported into the bypass passage 32 and back to the recording section.

Thus, the transport roller pair 29 rotatable at a higher peripheral speed than the fixing roller pair 28A acts as a recording paper separating device for separating two sheets of recording paper P sent in an overlapping state from the recording section.

The page arranging recording in the fourth embodiment is carried out in substantially the same way as illustrated in the flowchart of FIG. 7 for the third embodiment. In the third embodiment, step #213 is executed to check if the recording paper is in position. In this embodiment, the position checked may have a wider range since the fresh sheet P1 and refed sheet P2 of the recording paper overlap each other. This means that almost no waiting time is takes place in a continuous recording operation in the page arranging mode.

Two modifications of the fourth embodiment will be described next.

Figure 9:
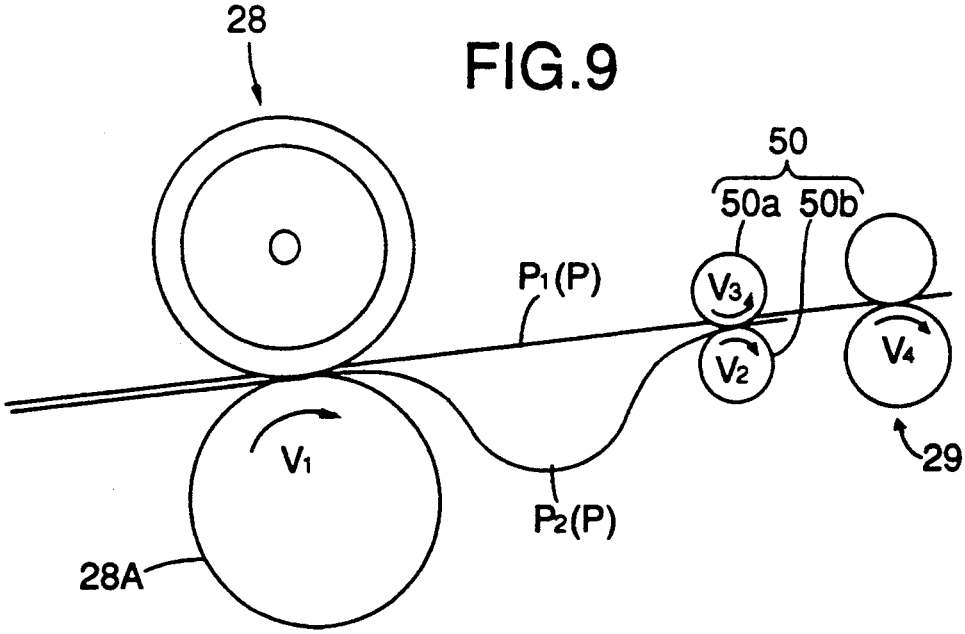
FIG. 9 is a schematic view of a modified recording paper separating device.

(1) As shown in FIG. 9, the recording paper separating device may include a control roller pair 50 having an upper and a lower drive rollers 50*a* and 50*b* disposed between the fixing device 28 and transport roller pair 29. The lower roller 50*b* is rotatable at a peripheral speed V2 which is lower than the peripheral speed V1 of the fixing roller pair 28A, and the upper roller 50*a* at a peripheral speed V3 which is greater than the peripheral speed V1 of the fixing roller pair 28A, with the transport roller pair 29 rotatable at a maximum peripheral speed V4. That is, the four peripheral speeds V1–V4 of the rollers are in a relationship $V4>=V3>V1>V2$ or $V4>V3>=V1>V2$. This arrangement assures separation of a fresh sheet P1 and a refed sheet P2 of the recording paper.

As illustrated, after two sheets of recording paper P1 and P2 are transported in an overlapping state out of the fixing device 28 and reach the control roller pair 50, the fresh sheet of recording paper P1 lying on top is transported by the fixing roller pair 28A and the upper roller 50*a* faster than the leading end of the refed sheet of recording paper P2 which is transported by the lower roller 50*b*. As a result, the leading end of the fresh sheet P1 advances ahead. As soon as the rear ends of the two sheets P1 and P2 become free of the nip by the fixing roller pair 28A, the fresh sheet P1 is transported only by the upper roller 50*a* rotating at a higher peripheral speed than the fixing roller pair 28A. Consequently, the fresh sheet P1 is transported faster, with the refed sheet P2 following at the same speed, whereby the two sheets P1 and P2 become staggered and separated at the transport roller pair 29 as in the foregoing embodiment.

According to this construction, as described above, two sheets of the recording paper may be placed in a perfectly overlapping state at the recording section. The two sheets may, for example, be fed to the recording section as perfectly overlapping each other with the lead ends placed in register by causing either the blank sheet of the recording paper P fed by the paper feeding device PS or the refed sheet fed by the paper refeeding device to standby for synchronization at the timing roller pair 18. This will avoid a transfer or fixation failure due to a stepped part formed by the image-carrying sheet staggeredly underlying the blank sheet on which an image is formed by the image forming device. Further, there is no possibility of staining the reverse side of the image-carrying sheet which would occur when this sheet is transported through the recording section with part of the reverse side exposed.

(2) The fourth embodiment has been described as having the transport roller pair 29 downstream of the fixing device 28 rotatable at a higher peripheral speed than the fixing roller pair 28A. Instead, the transport roller pair 29 may be rotatable at the same peripheral speed as the fixing roller pair 28A, with the paper transport mechanisms of the discharge and refeeding devices spaced from the transport roller pair 29 by distances not exceeding the length of the recording paper P, both paper transport mechanisms providing a transport speed faster than the peripheral speed of the transport roller pair 29.

The following modifications may be made in relation to the image forming device according to the present invention:

a: Where the recording paper is transported from the intermediate tray straight through the recording section to the discharge tray for page arranging purposes, the transport speed may be increased substantially over the transport speed for recording. This assures a speedy operation.

b: The image forming device in the foregoing embodiments includes the optical printing head PH having the PLZT shutter array 62 for forming an image corresponding to input recording information. The optical printing head PH may have a liquid crystal shutter array or a LED array instead. Further, the optical printing head PH may comprise the type to emit light beams such as laser beams to the photoreceptor drum 6.

c: The DC motor DM provided in the foregoing embodiments for driving the scanning device may be replaced by a stepper motor or various other types of motors. Where a stepper motor is employed, pulses for driving this motor may be counted. Then the position of the scanning device may be detected without necessitating an optical encoder as in the described embodiments.

d: The photoreceptor drum 6 may be replaced by a belt-like photosensitive element wound around a pair of rollers.

e: In the foregoing embodiments, the exposure lamp 2 and slit 3 are movable while the document M is held stationary on the document table 1, for copying the document M. Alternatively, the exposure lamp 2 and slit 3 may be fixed against movement, with the document table 1 designed movable.

f: In the foregoing embodiments, both the operation for copying documents and operation for printing images based on input recording information utilize the electrophotographic process and share the same components excluding the construction for exposing the photosensitive member 6, to realize a low cost system. However, the present invention may be practiced by providing separate constructions for the copying and printing operations. For example, while the two operations utilize the electrophotographic process, separate photoreceptors, separate fixing devices and the like may be provided. The printing operation may be carried out by an ink jet system or a thermal transfer system, with the copying operation carried out by the electrophotographic process. Further, the recording system may comprise only the construction for copying documents or the construction for printing images based on input recording information.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming system for carrying out simplex recording in which images are continuously formed on one side of recording paper by an image forming device and the recording paper is discharged directly onto a discharge tray, and composite recording in which recording paper carrying an image on one side thereof is refed to the image forming device for forming a further image on the same image-carrying side and the recording paper is thereafter discharged onto the discharge tray, said image forming system comprising:

paper refeed means for temporarily storing the recording paper after the simplex recording and refeeding the recording paper to said image forming device for recording an image on the same image-carrying side thereof;

mode select means for selecting between a page arranging mode for discharging the recording paper onto said discharge tray with a reverse side of a sheet of the recording paper carrying an image on one side thereof being in contact with an image-carrying side of a next sheet of the recording paper, and a non-page arranging mode for discharging the recording paper onto said discharge tray with the image-carrying side of a sheet of the recording paper in contact with the reverse side of a next sheet of the recording paper; and control means for causing the recording paper carrying an image formed on one side thereof by said image forming device to be discharged directly onto said discharge tray when said non-page arranging mode is selected, for causing the recording paper carrying an image formed on one side thereof by said image forming device to be transported through said image forming device again by said paper refeed means and discharged onto said discharge tray when said page arranging mode is selected, and rendering said image forming device inoperative when the recording paper fed by said paper refeed means passes therethrough.

2. An image forming system as claimed in claim 1, wherein said paper refeed means includes an intermediate tray for storing the recording paper, a first path for turning over the recording paper carrying an image on one side thereof an odd number of times and stacking the recording paper on said intermediate tray in order of delivery thereto, pickup means for picking up the recording paper, starting with a top sheet thereof, from said intermediate tray, and a second path for turning over the recording paper picked up from said intermediate tray an odd number of times and transporting the recording paper to said image forming device.

3. An image forming system as claimed in claim 2, further comprising detect means for detecting an amount of the recording paper stored in said paper refeed means, and interrupt means operable in response to said detect means for discontinuing operation of said image forming device and starting a paper pickup operation, the recording paper picked up being discharged to and stacked on said discharge tray.

4. An image forming system as claimed in claim 3, further comprising resume means for resuming a recording operation by said image forming device and a paper storing operation by said paper refeed means after the recording paper is all removed from said intermediate tray.

5. An image forming system as claimed in claim 2, wherein said paper refeed means includes an intermediate tray for storing the recording paper, a first path for turning over the recording paper carrying an image on one side thereof an even number of times and stacking the recording paper on said intermediate tray in order of delivery thereto, pickup means for picking up the recording paper, starting with a bottom sheet thereof, from said intermediate tray, and a second path for turning over the recording paper picked up from said intermediate tray an odd number of times and transporting the recording paper to said image forming device.

6. An image forming system for carrying out single recording in which an image is formed on recording paper once by an image forming device, and multiple recording in which recording paper carrying an image is temporarily stored on an intermediate tray and refed to the image forming device for forming a further image thereon, said image forming system comprising:

a first path for turning over the recording paper carrying an image an odd number of times and delivering the recording paper to said intermediate tray and stacking the recording paper on said intermediate tray in order of delivery;

a second path for delivering the recording paper to a discharge tray;

switch means for selectively delivering the recording paper carrying an image to said first path and said second path;

mode select means for selecting between a page arranging mode and a non-page arranging mode for the single recording;

control means for controlling said switch means to deliver the recording paper after the single recording to said first path when the page arranging mode is selected, whereby the recording paper is stacked with a reverse side of a sheet of the recording paper carrying an image on one side thereof being in contact with an image-carrying side of a next sheet of the recording paper, and for controlling said switch means to deliver the recording paper after the single recording directly to said second path when the non-page arranging mode is selected, whereby the recording paper is stacked on said discharge tray with the image-carrying side of a sheet of the recording paper in contact with the reverse side of a next sheet of the recording paper.

7. An image forming system as claimed in claim 6, further comprising support means for supporting said intermediate tray to be movable from a main body, the recording paper being manually removed from said intermediate tray after drawing said intermediate tray from said main body.

8. An image forming system as claimed in claim 6, further comprising paper refeed means for picking up the recording paper, starting with a top sheet thereof, from said intermediate tray, and a third path for turning over the recording paper picked up from said intermediate tray an odd number of times and transporting the recording paper to said image forming device, the recording paper being picked up from said intermediate tray by said paper refeed means and discharged onto said discharge tray by way of said third path, said image forming device and said first path.

9. An image forming system for carrying out simplex recording in which images are continuously formed on one side of recording paper by an image forming device and the recording paper is discharged directly onto a discharge tray, and duplex recording in which recording paper carrying an image on one side thereof is refed to the image forming device for forming a further image on a reverse side of the recording paper and the recording paper is thereafter discharged onto the discharge tray, said image forming system comprising:

paper refeed means for temporarily storing the recording paper after the simplex recording and refeeding the recording paper to said image forming device for recording an image on the reverse side thereof;

mode select means for selecting between a page arranging mode for discharging the recording paper onto said discharge tray with a reverse side of a sheet of the recording paper carrying an image on one side thereof being in contact with an image-carrying side of a next sheet of the recording paper, and a non-page arranging mode for discharging the recording paper onto said discharge tray with the image-carrying side of a sheet of the recording paper in contact with the reverse side of a next sheet of the recording paper; and control means for causing the recording paper carrying an image formed on one side thereof by said image forming device to be discharged directly onto said discharge tray when said non-page arranging mode is selected, for causing the recording paper carrying an image formed on one side thereof by said image forming device to be transported through said image forming device again by said paper refeed means and discharged onto said discharge tray when said page arranging mode is selected, and rendering said image forming device inoperative when the recording paper fed by said paper refeed means passes therethrough.

10. In an image forming apparatus capable of carrying out a recording operation in a simple recording mode in which recording paper once recorded at a recording section is directly discharged onto a discharge tray, and a recording operation in a multiple recording mode in which the recording paper once recorded at the recording section is temporarily stored on an intermediate tray from which the recording paper is refed to the recording section for forming a further image thereon and thereafter discharged onto the discharge tray, a method of producing simplex records as arranged in order comprising the steps of:

selecting between an arranging mode and a non-arranging mode;

discharging the recording paper having been recorded at said recording section onto said discharge tray when said non-arranging mode is selected; and delivering the recording paper having been recorded at said recording section to said intermediate tray after said recording paper has been turned over an odd number of times when said arranging mode is selected.

11. A method as claimed in claim 10, further comprising the step of discharging the recording paper from said intermediate tray to said discharge tray after turning over the recording paper 5 an odd number of times.

12. An image forming system for carrying out simplex recording in which images are continuously formed on one side of recording paper by an image forming device and the recording paper is discharged directly onto a discharge tray, and duplex recording in which recording paper carrying an image on one side thereof is refed to the image forming device for forming a further image on a reverse side of the recording paper and the recording paper is thereafter discharged onto the discharge tray, said image forming system comprising:

paper feed means for feeding blank recording paper to said image forming device;

paper refeed means for refeeding the recording paper carrying an image formed on one side thereof to said image forming device after turning over the recording paper an odd number of times;

switch means for selectively delivering image-carrying recording paper to said discharge tray and said paper refeed means;

mode select means for selecting between a page arranging mode for discharging the recording paper onto said discharge tray with a reverse side of a sheet of the recording paper carrying an image on one side thereof being in contact with an image-carrying side of a next sheet of the recording paper, and a non-page arranging mode for discharging the recording paper onto said discharge tray with the image-carrying side of a sheet of the recording paper in contact with the reverse side of a next sheet of the recording paper; and control means for controlling said switch means to discharge the recording paper carrying an image formed on one side thereof by said image forming device directly onto said discharge tray when said non-page arranging mode is selected, and for alternately actuating said paper feed means and said paper refeed means and controlling said switch means to deliver the recording paper fed by said paper feed means to said paper refeed means and to deliver the recording paper fed by said paper refeed means to said discharge tray when said page-arranging mode is selected, said image forming device being inoperative when the recording paper fed by said paper refeed means passes therethrough.

13. An image forming system for carrying out simplex recording in which images are continuously formed on one side of recording paper by an image forming device and the recording paper is discharged directly onto a discharge tray, and duplex recording in which recording paper carrying an image on one side thereof is refed to the image forming device for forming a further image on a reverse side of the recording paper and the recording paper is thereafter discharged onto the discharge tray, said image forming system comprising:

paper feed means for feeding blank recording paper to said image forming device;

paper refeed means for refeeding the recording paper carrying an image formed on one side thereof to said image forming device after turning over the recording paper an odd number of times;

switch means for selectively delivering image-carrying recording paper to said discharge tray and said paper refeed means;

mode select means for selecting between a page arranging mode for discharging the recording paper onto said discharge tray with a reverse side of a sheet of the recording paper carrying an image on one side thereof being in contact with an image-carrying side of a next sheet of the recording paper, and a non-page arranging mode for discharging the recording paper onto said discharge tray with the image-carrying side of a sheet of the recording paper in contact with the reverse side of a next sheet of the recording paper; and control means for controlling said switch means to discharge the recording paper carrying an image formed on one side thereof by said image forming device directly onto said discharge tray when said non-page arranging mode is selected, and for simultaneously actuating said paper feed means and said paper refeed means and controlling said switch means to deliver the recording paper fed by said paper feed means to said paper refeed means and to deliver the recording paper fed by said paper refeed means to said discharge tray when said page-arranging mode is selected.

14. An image forming system as claimed in claim 13, wherein said switch means is constructed as a passage switching lever for connecting said recording section selectively to a discharge passage leading to said discharge tray and a bypass passage leading to said intermediate tray, and wherein a transport roller pair is provided upstream of said passage switching lever and a fixing roller pair provided upstream of said transport roller pair with respect to a direction of paper transport by said passage switching lever, said transport roller pair being rotatable at a higher peripheral speed than said fixing roller pair.

15. An image forming system as claimed in claim 13, wherein said switch means is constructed as a passage switching lever for connecting said recording section selectively to a discharge passage leading to said discharge tray and a bypass passage leading to said intermediate tray, and wherein a transport roller pair is provided upstream of said passage switching lever and a fixing roller pair provided upstream of said transport roller pair with respect to a direction of paper transport by said passage switching lever, with a control roller pair including an upper roller and a lower roller disposed between said transport roller pair and said fixing roller pair, the respective roller pairs being set to the peripheral speeds: $V4 >= V3 > V1 > V2$ where V1 is a peripheral speed of said fixing roller pair, V2 is a peripheral speed of said lower roller, V3 is a peripheral speed of said upper roller and V4 is a peripheral speed of said transport roller pair.

16. An image forming system as claimed in claim 13, wherein said switch means is constructed as a passage switching lever for connecting said recording section selectively to a discharge passage leading to said discharge tray and a bypass passage leading to said intermediate tray, and wherein a transport roller pair is provided upstream of said passage switching lever and a fixing roller pair provided upstream of said transport roller pair with respect to a direction of paper transport by said passage switching lever, with a control roller pair including an upper roller and a lower roller disposed between said transport roller pair and said fixing roller pair, the respective roller pairs being set to the peripheral speeds: $V4 > V3 >= V1 > V2$ where V1 is a peripheral speed of said fixing roller pair, V2 is a peripheral speed of said lower roller, V3 is a peripheral speed of said upper roller and V4 is a peripheral speed of said transport roller pair.

17. A photocopier including a document table for successively supporting a plurality of original documents in a particular order and in which photocopier a corresponding plurality of image-bearing papers may be formed by forming an image of said plurality of original documents on a respective plurality of recording papers, comprising:

a main body;

a paper supplying device including at least one paper feeder delivering the recording papers;

means for forming images on the recording papers and thereby providing the plurality of image-bearing papers;

means for designating one of:

an arranging mode wherein the image-bearing papers are discharged in said particular order with an image-carrying side of a succeeding paper contacting a reverse side of a preceding paper; and a non-arranging mode wherein the image-bearing papers are discharged in an order opposite to said particular order with the reverse side of a succeeding paper contacting the image-carrying side of a preceding paper;

a first discharge tray;

a second discharge tray located inside of said main body;

means for automatically discharging image-bearing papers to one of said first and second discharge trays in accordance with said designating means and including:

a first discharge passage discharging the image-bearing papers to said first paper discharge tray in a first direction whereby the image-bearing papers are discharged in said non-arranging mode;

a second discharge passage discharging the image-bearing papers to said second paper discharge tray in a second direction whereby said image-bearing papers are discharged in said arranging mode; and support means for movably supporting said second discharge tray between a first position inside of said main body where the image-hearing papers may be discharged in said arranging mode and a second position outside of said main body where the image-bearing papers may be manually removed.

18. The photocopier of claim 17, wherein said first discharge tray is located outside of said main body.

19. The photocopier of claim 17, wherein said second discharge tray is comprised of an intermediate tray operating in a first mode for temporarily storing and then refeeding discharged image-bearing sheets to said image forming means during a duplex copying operation and operating in a second mode for receiving but not refeeding discharged image-bearing sheets when the arranging mode is designated during a simplex copying operation.

20. An image forming system for carrying out simplex recording in which images are continuously formed on one side of recording paper by an image forming device and the recording paper is discharged directly onto a discharge tray, and duplex recording in which recording paper carrying an image on one side thereof is refed to the image forming device for forming an image on a reverse side of the recording paper and the recording paper is thereafter discharged onto the discharge tray, said image forming system comprising:

paper feed means for feeding blank recording paper to said image forming device;

paper refeed means for refeeding the recording paper carrying an image on one side thereof to said image forming device after turning over the recording paper an odd number of times;

switch means for selectively delivering image-carrying recording paper to one of said discharge tray and said paper refeed means;

mode select means for selecting between a page arranging mode for discharging the recording paper onto said discharge tray with a reverse side of a sheet of the recording paper carrying an image on one side thereof being in contact with an image-carrying side of a next sheet of the recording paper, and a non-page arranging mode for discharging the recording paper onto said discharge tray with the image-carrying side of a sheet of the recording paper in contact with the reverse side of a next sheet of the recording paper; and control means for controlling said switch means to discharge the recording paper carrying an image on one side thereof directly onto said discharge tray when said non-page arranging mode is selected, and for actuating said paper feed means and said paper refeed means selectively and controlling said switch means to deliver the recording paper fed by said paper feed means to said paper refeed means and to deliver the recording paper fed by said paper refeed means to said discharge tray when said page-arranging mode is selected, said image forming device being inoperative when the recording paper fed by said paper refeed means passes therethrough.

* * * * *